US011245220B2

(12) United States Patent
Ebata et al.

(10) Patent No.: US 11,245,220 B2
(45) Date of Patent: Feb. 8, 2022

(54) CONNECTOR INCLUDING SANDWICHED CONFIGURATION

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Daisuke Ebata, Mie (JP); Motohiro Yokoi, Mie (JP); Shigeki Ikeda, Mie (JP); Ryuta Takakura, Mie (JP); Tetsuya Nishimura, Mie (JP); Haruka Nakano, Mie (JP); Kenta Arai, Mie (JP); Yasuo Omori, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/960,429

(22) PCT Filed: Oct. 22, 2018

(86) PCT No.: PCT/JP2018/039127
§ 371 (c)(1),
(2) Date: Jul. 7, 2020

(87) PCT Pub. No.: WO2019/142422
PCT Pub. Date: Jul. 25, 2019

(65) Prior Publication Data

US 2020/0373702 A1 Nov. 26, 2020

(30) Foreign Application Priority Data

Jan. 22, 2018 (JP) ..... JP2018-007953

(51) Int. Cl.
*H01R 13/506* (2006.01)
*H01R 13/514* (2006.01)
*H01R 13/56* (2006.01)

(52) U.S. Cl.
CPC ..... *H01R 13/506* (2013.01); *H01R 13/514* (2013.01); *H01R 13/56* (2013.01)

(58) Field of Classification Search
CPC .. H01R 13/502; H01R 13/506; H01R 13/514; H01R 13/56
(Continued)

(56) References Cited

U.S. PATENT DOCUMENTS 5,356,308 A * 10/1994 Toba ..... H01R 13/5219 439/422
6,375,492 B1 * 4/2002 Hio ..... H01R 12/68 439/422
(Continued)

FOREIGN PATENT DOCUMENTS

CN 1349284 A 5/2002
CN 1655407 A 8/2005
(Continued)

OTHER PUBLICATIONS

International Search Report issued in International Pat. Appl. No. PCT/JP2018/039127, dated Dec. 18, 2018, along with an English translation thereof.
(Continued)

*Primary Examiner* — Oscar C Jimenez
(74) *Attorney, Agent, or Firm* — Greenblum & Bernstein, P.L.C.

(57) ABSTRACT

Provided is a connector including: at least one plate-like housing body; a plurality of groove-like terminal housing chambers each opened in an upper surface of the housing body and parallelly arranged; a plurality of connection
(Continued)

terminals provided at ends of a plurality of electrical wirings and housed and disposed in the terminal housing chambers, respectively; an electrical wiring support part supporting the plurality of electrical wirings extending from a back end side opening part of the terminal housing chambers; a sheet-like reinforced member which is placed on an upper surface of the electrical wiring support part and the plurality of electrical wirings are fixed to in a state of parallelly arranged; and a cover part overlapping with the upper surface of the housing body to cover the terminal housing chambers and sandwiching the sheet-like reinforced member between the cover part and the electrical wiring support part.

7 Claims, 8 Drawing Sheets

(58) Field of Classification Search
USPC ..... 439/701
See application file for complete search history.

(56) References Cited

U.S. PATENT DOCUMENTS

| | | | | |
|---|---|---|---|---|
| 7,572,154 | B2 * | 8/2009 | Ichio | H01R 13/4361 361/735 |
| 7,798,821 | B2 * | 9/2010 | Liu | H01R 13/6658 439/76.1 |
| 2002/0026710 | A1 | 3/2002 | Murakami et al. | |
| 2002/0039860 | A1 | 4/2002 | Shirai et al. | |
| 2005/0176305 | A1 | 8/2005 | Wu | |
| 2006/0228932 | A1 * | 10/2006 | Komiyama | H01R 12/59 439/467 |
| 2020/0028306 | A1 * | 1/2020 | Makino | H05K 1/189 |
| 2020/0044376 | A1 * | 2/2020 | Ichikawa | H01R 12/778 |
| 2020/0335898 | A1 * | 10/2020 | Arai | H01R 13/518 |

FOREIGN PATENT DOCUMENTS

| | | | |
|---|---|---|---|
| JP | 04-329270 | A | 11/1992 |
| JP | 05-266935 | A | 10/1993 |
| JP | 09-129307 | A | 5/1997 |
| JP | 2001-060477 | A | 3/2001 |
| JP | 2001-230038 | A | 8/2001 |
| JP | 2002-158061 | A | 5/2002 |
| JP | 2005-190717 | A | 7/2005 |

OTHER PUBLICATIONS

International Preliminary Report on Patentability issued in International Pat. Appl. No. PCT/JP2018/039127, dated Aug. 20, 2019, along with an English translation thereof.

U.S. Appl. No. 16/960,409 to Arai et al., filed Jul. 7, 2020.

Chinese Office Action, Chinese Patent Office, Application No. 201880087227.0, dated Mar. 10, 2021, English translation.

* cited by examiner

CONNECTOR INCLUDING SANDWICHED CONFIGURATION

TECHNICAL FIELD

The present invention relates to a connector used for a wire harness routed in an automobile, for example.

BACKGROUND ART

Conventionally, a connector attached to a terminal of a wire harness includes a plurality of connection terminals each provided at each of a plurality of wiring ends constituting the wire harness and a connector housing including a plurality of terminal housing chambers each housing and holding each of the plurality of connection terminals. The terminal housing chamber of the connector housing has a tubular shape whose four sides are surrounded by a peripheral wall part, thus needed is an operation of inserting the plurality of connection terminals provided at the wiring end into the terminal housing chamber one by one in manufacturing the connector, and such an operation causes a deterioration in operability.

In contrast, as disclosed in Japanese Patent Application Laid-Open No. 2001-230038 (Patent Document 1), for example, proposed is a structure that a plate-like housing in which a plurality of groove-like terminal housing chambers are arranged side by side is adopted, and performed is an operation of inserting a plurality of connection terminals from above into the plurality of groove-like terminal housing chambers opened in an upper surface of the housing to increase the operability.

PRIOR ART DOCUMENTS

Patent Documents

Patent Document 1: Japanese Patent Application Laid-Open No. 2001-230038

SUMMARY

Problem to be Solved by the Invention

However, when such a groove-like terminal housing chamber is adopted, the upper surface of the terminal housing chamber is opened, thus stress tends to be concentrated on the electrical wiring extending from the back end side opening part of the terminal housing chamber in an assembly operation or in use. When an electrical wiring has a low strength, such as an extra-fine wiring, the strength of electrical wiring is hardly secured, and it is difficult to even adopt the groove-like terminal housing chamber in some cases.

The present invention is done on the background of the above circumstance, and a problem to be solved is to provide a connector having a novel structure capable of stably securing a strength of an electrical wiring extending from a terminal housing chamber even when a groove-like terminal housing chamber opened upward is adopted.

Means to Solve the Problem

A first embodiment of the present invention is a connector including: at least one plate-like housing body; a plurality of groove-like terminal housing chambers each provided at a front end side of the housing body in a length direction, opened in an upper surface of the housing body, and parallelly arranged to house a plurality of connection terminals provided at ends of a plurality of electrical wiring; an electrical wiring support part provided at a back end side of the housing body in a length direction to support the plurality of electrical wirings extending from a back end side opening part of the terminal housing chambers; a sheet-like reinforced member which is placed on an upper surface of the electrical wiring support part and the plurality of electrical wirings are fixed to in a parallel state; and a cover part overlapping with the upper surface of the housing body to cover the terminal housing chambers and sandwiching the sheet-like reinforced member between the cover part and the electrical wiring support part, wherein a positioning protrusion is provided on the upper surface of the electrical wiring support part or a lower surface of the cover part, and the sheet-like reinforced member has a positioning hole into which the positioning protrusion is fitted, and the positioning protrusion is fitted into the positioning hole to fix the sheet-like reinforced member to the upper surface of the electrical wiring support part.

Effects of the Invention

According to the present invention, provided is a connector capable of stably securing a strength of an electrical wiring extending from a terminal housing chamber even when a groove-like terminal housing chamber opened upward is adopted.

DESCRIPTION OF EMBODIMENT(S)

Figure 1:
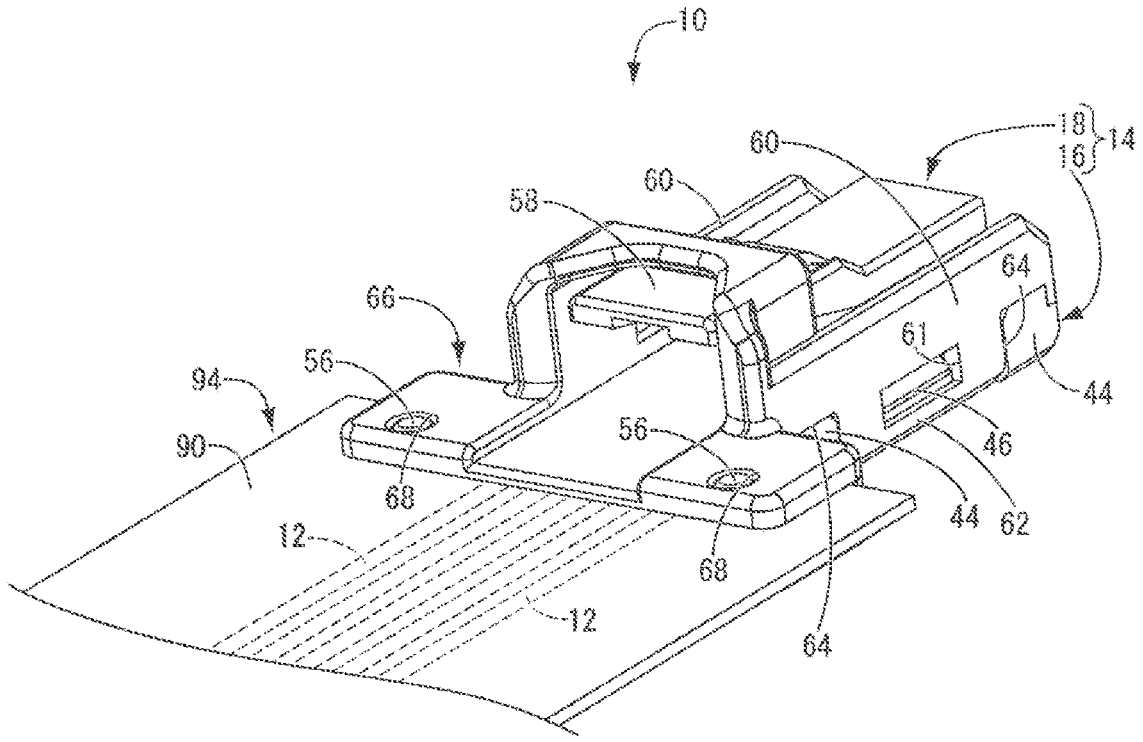
FIG. 1 An overall perspective view illustrating a connector as a first embodiment of the present invention.

Embodiments of the present invention are listed and described first.

A first embodiment of the present invention is a connector including: at least one plate-like housing body; a plurality of groove-like terminal housing chambers each provided at a front end side of the housing body in a length direction, opened in an upper surface of the housing body, and parallelly arranged to house a plurality of connection terminals provided at ends of a plurality of electrical wirings; an electrical wiring support part provided at a back end side of the housing body in a length direction to support the plurality of electrical wirings extending from a back end side opening part of the terminal housing chambers; a sheet-like reinforced member which is placed on an upper surface of the electrical wiring support part and the plurality of electrical wirings are fixed to in a state of parallelly arranged; and a cover part overlapping with the upper surface of the housing body to cover the terminal housing chambers and sandwiching the sheet-like reinforced member between the cover part and the electrical wiring support part, wherein a positioning protrusion is provided on the upper surface of the electrical wiring support part or a lower surface of the cover part, and the sheet-like reinforced member has a positioning hole into which the positioning protrusion is fitted, and the positioning protrusion is fitted into the positioning hole to fix the sheet-like reinforced member to the upper surface of the electrical wiring support part.

According to the present embodiment, the terminal housing chamber provided in the housing body has the groove-like shape opened upward, thus in the process of housing the connection terminals provided at the ends of the electrical wirings, the plurality of connection terminals can be collectively fitted into the plurality of terminal housing chambers from above, and operability can be significantly increased compared with a conventional case where the plurality of connection terminals are housed one by one in a tubular terminal housing chamber whose four sides are surrounded by peripheral walls. Furthermore, the concentration of stress on the electrical wiring extending from the terminal housing chamber, which is concerned in adopting the groove-like terminal housing chamber, is also reduced by supporting the plurality of electrical wirings with the electrical wiring support part extending from the back end side opening part of the terminal housing chamber. In addition, the plurality of electrical wirings extending from the back end side opening part of the terminal housing chamber are fixed to the sheet-like reinforced member in the state of parallelly arranged and placed on the upper surface of the electrical wiring support part, and further sandwiched between the cover part overlapping with the upper surface of the housing body and the upper surface of the housing body, thus an external force applied on the plurality of electrical wirings can be reliably avoided or reduced, and the securement of the strength of electrical wiring in this portion can be reliably achieved. Thus, the groove-like terminal housing chamber can be adopted even when an extra-fine wiring is adopted as the electrical wiring.

A second embodiment of the present invention is the connector according to the first embodiment, wherein the cover part and the housing body are mutually locked and fitted by a locking mechanism provided on a side wall, and the locking mechanism is provided in a position different from the positioning protrusion in a longitudinal direction of the housing body.

According to the present embodiment, the cover part and the housing body are mutually locked and fitted by the locking mechanism provided on the side wall, thus an overlapping state of the cover part and the housing body can be stably held, and the sheet-like reinforced member can be sandwiched more stably between the electrical wiring support part and the cover part.

A third embodiment of the present invention is the connector according to the first or second embodiment, wherein a plurality of groove-like electrical wiring housing grooves are opened in the upper surface of the electrical wiring support part and parallelly arranged in the upper surface of the electrical wiring support part. The electrical wiring housing grooves are connected to the back end side opening part of the terminal housing chambers and opened on the back end side of the housing body.

According to the present embodiment, the plurality of electrical wiring housing grooves are connected to the back end side opening part of the terminal housing chambers, opened in the upper surface of the electrical wiring support part, and parallelly arranged, thus the plurality of electrical wirings fixed to the sheet-like reinforced member can be fitted into each of the electrical wiring housing grooves, and housed and held therein. Accordingly, the sheet-like reinforced member can be tightly sandwiched between the electrical wiring support part and the cover part, a misalignment of the sheet-like reinforced member can be reliably prevented, and avoidance of transmission of external force to the electrical wiring and the securement of the strength can be achieved more advantageously.

A fourth embodiment of the present invention is the connector according to any one of the first to third embodiments, wherein the plurality of housing bodies are vertically stacked in layers, a lower surface of the housing body on an upper side overlapping with the housing body on a lower side constitutes a middle cover part overlapping with the upper surface of the housing body on the lower side, covering each of the terminal housing chambers, and sandwiching the sheet-like reinforced member between the middle cover part and the electrical wiring support part, a second positioning concave part into which the positioning protrusion, which is provided to protrude from the electrical wiring support part in the housing body on a lower side, is fitted is provided in the middle cover part, and the housing bodies vertically stacked are positioned and fixed by fitting the positioning protrusion into the second positioning concave part.

According to the present embodiment, the plurality of housing bodies are vertically stacked in layers, thus a laminated connector can be easily provided. Particularly, the lower surface of the housing body constitutes the middle cover part thereby being able to cover the terminal housing chamber and sandwich the sheet-like reinforced member between the middle cover part and the electrical wiring support part, thus the number of components can be reduced and the configuration can be simplified.

Embodiments of the present invention are described with reference to the drawings hereinafter. In all of the drawings, the similar reference numerals will be assigned to the similar constituent elements, and the description is appropriately omitted.

Figure 2:
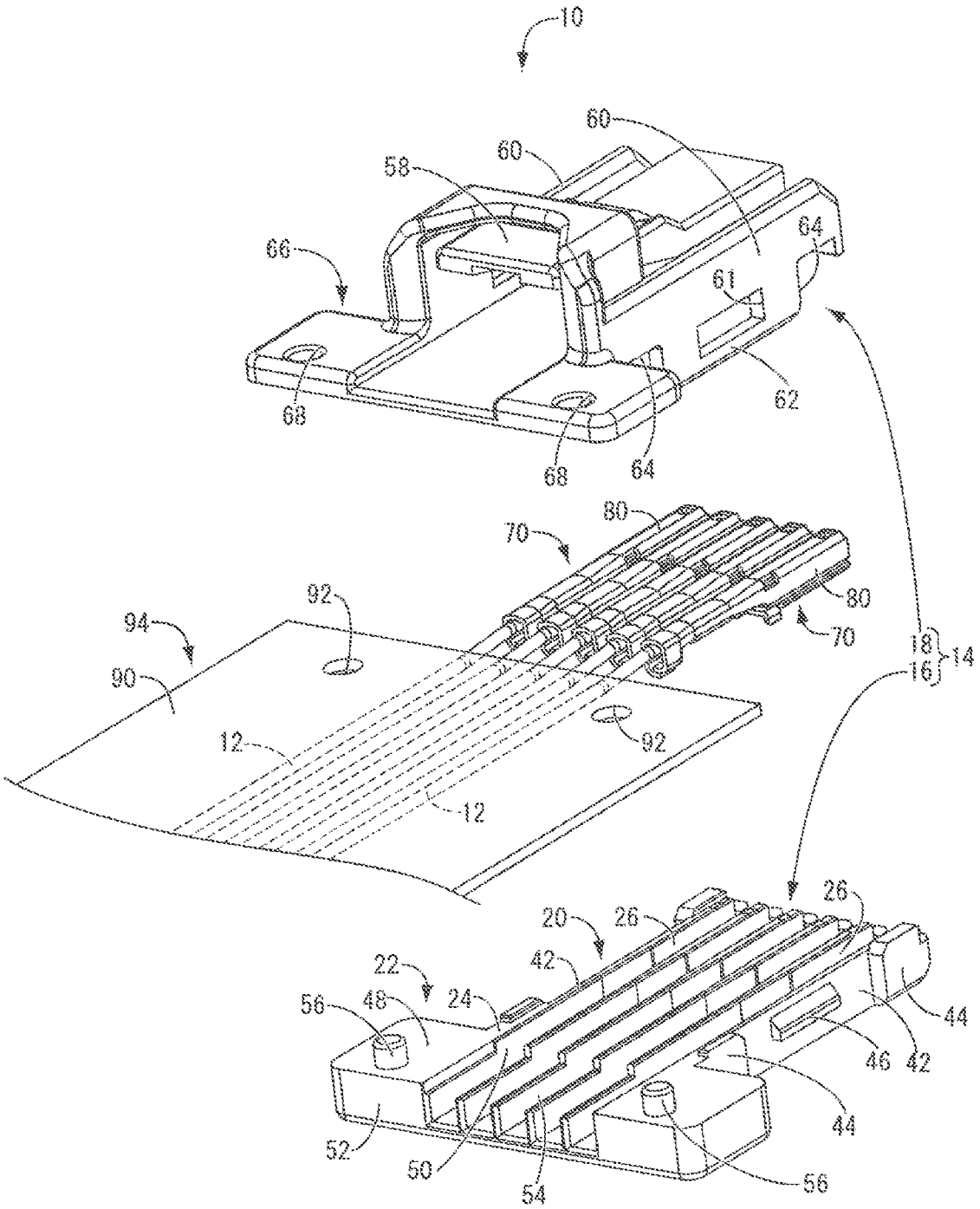
FIG. 2 An exploded perspective view of the connector illustrated in FIG. 1.
Figure 3:
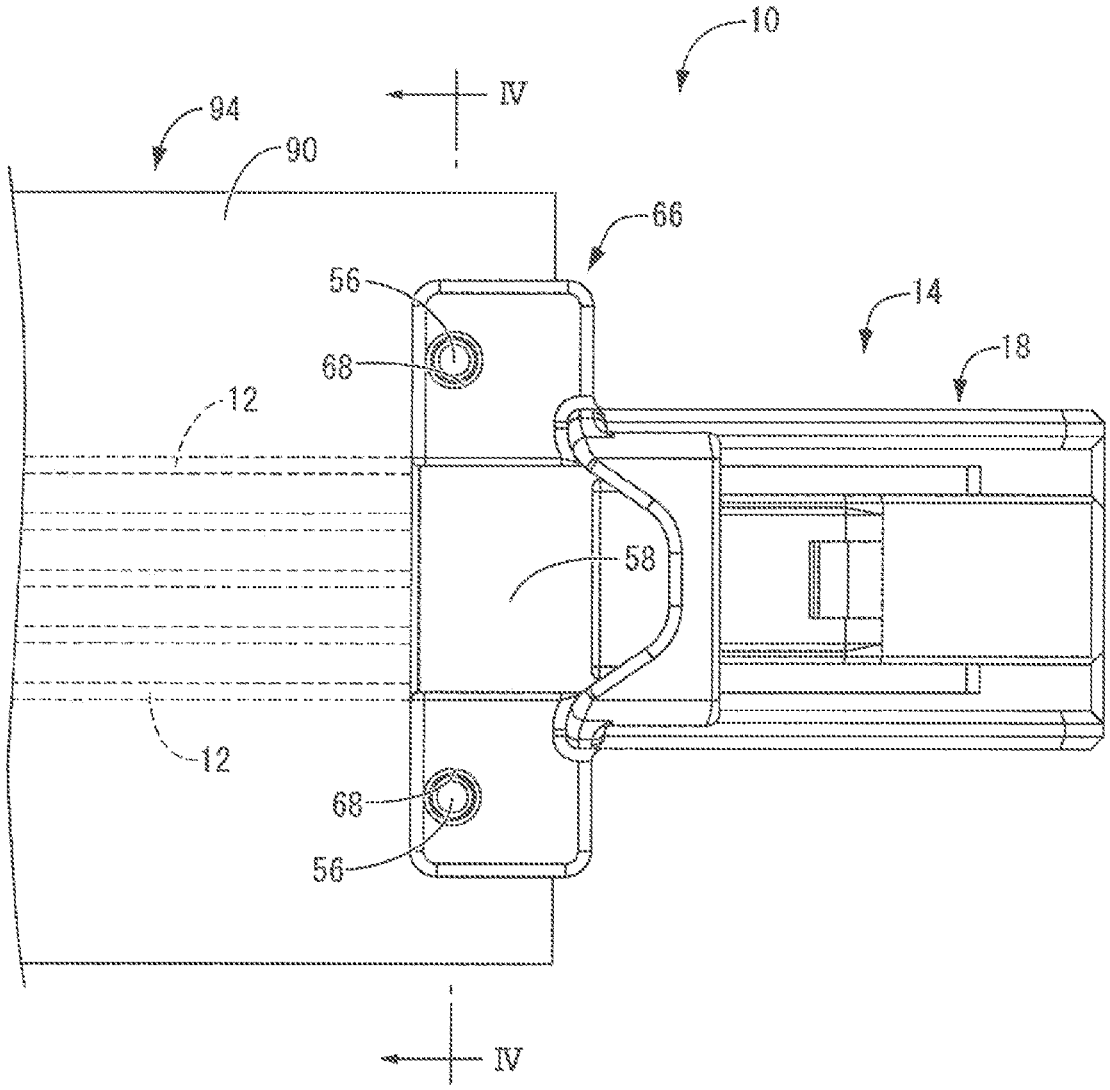
FIG. 3 A planar view of the connector illustrated in FIG. 1.
Figure 4:
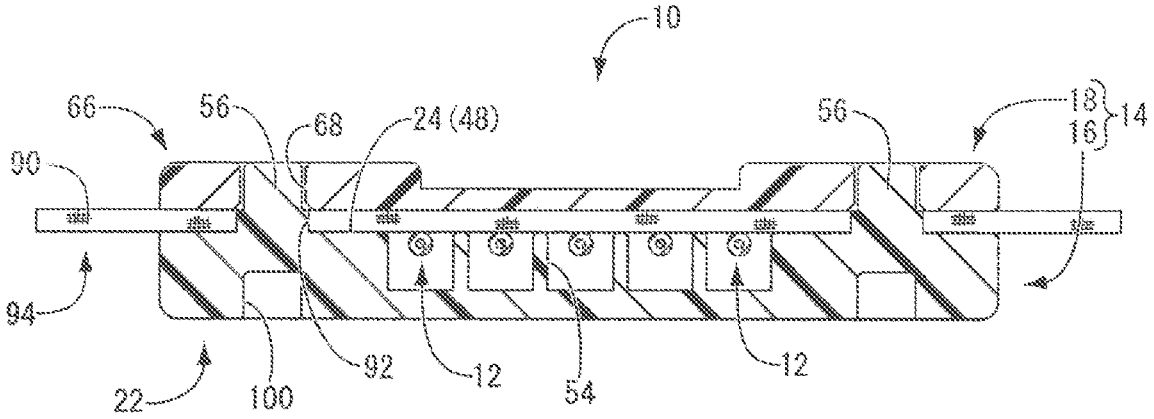
FIG. 4 An enlarged view of IV-IV cross-sectional surface in FIG. 3.

FIGS. 1 to 8 illustrate a connector 10 as a first embodiment of the present invention. As illustrated in FIGS. 1 to 3, the connector 10 includes a plurality of (five in the present embodiment) electrical wirings 12 and a connector housing 14 provided at an end of the plurality of electrical wirings 12. A front side (a right side in FIG. 3) of the connector 10 is connected to the other side connector provided for various electrical components not shown in the drawings. In the description hereinafter, an upper side indicates an upper side in FIGS. 1, 2, and 4, a lower side indicates a lower side in FIGS. 1, 2, and 4, a front side indicates a right side in FIG. 3, a back side indicates a left side in FIG. 3, a length direction indicates a right-left direction in FIG. 3, and a width direction indicates an up-down direction in FIG. 3.

Figure 5:
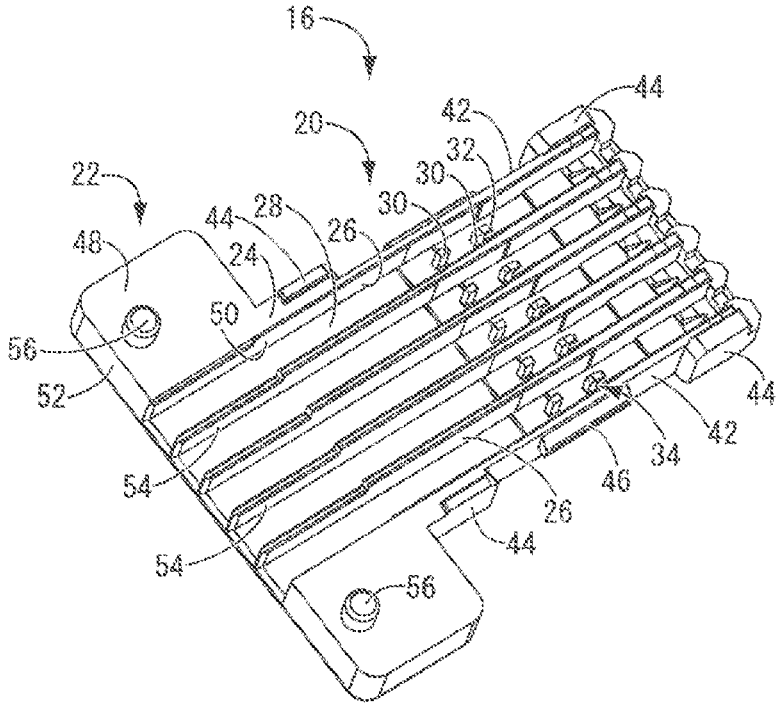
FIG. 5 A perspective view of a housing body illustrated in FIG. 2 seen from the other direction.
Figure 6:
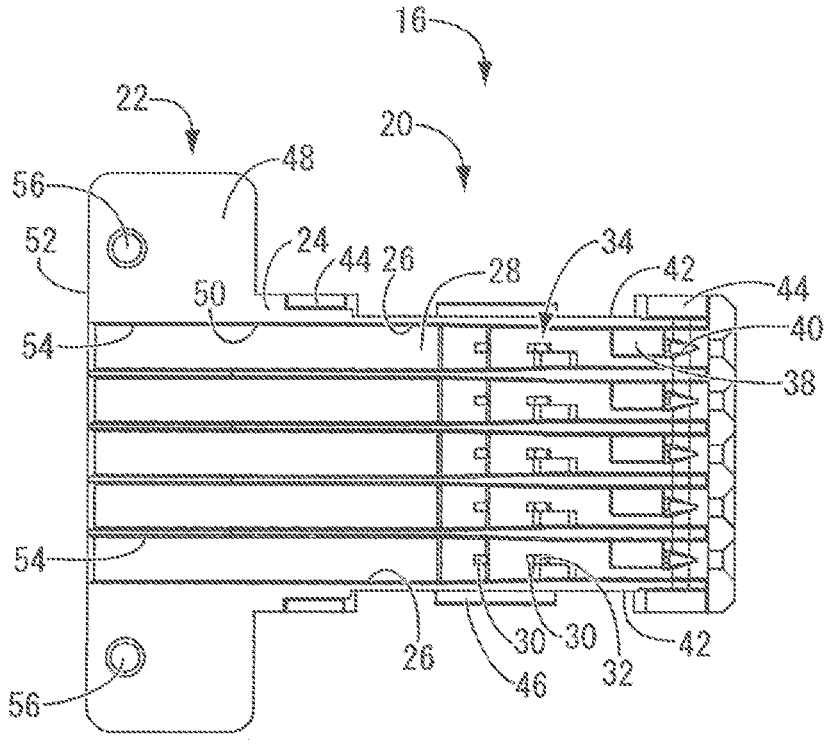
FIG. 6 A planar view of the housing body illustrated in FIG. 5.
Figure 8:
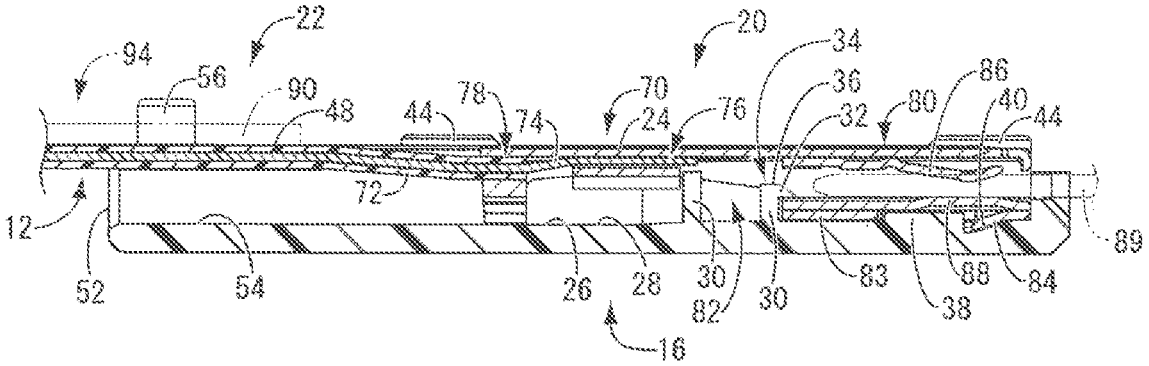
FIG. 8 An enlarged view of VIII-VIII cross-sectional surface in FIG. 7.

As illustrated in FIG. 2, the connector housing 14 includes a housing body 16 and a cover part 18 each integrally formed of a synthetic resin such as polypropylene (PP) and polyamide (PA) by injection molding, for example. As illustrated in FIGS. 2, 5, and 6, the housing body 16 substantially has a plate-like shape. A terminal housing part 20 substantially having a horizontally-long rectangular shape in a planar view is provided at a front end side (a right end side in FIG. 6) of the housing body 16 in a length direction, and an electrical wiring support part 22 substantially having a vertically-long rectangular shape in a planar view is provided at a back end side (a left end side in FIG. 6) of the housing body 16 in the length direction. More specifically, a plurality of terminal housing chambers 26 each having a substantially groove-like shape are provided in the terminal housing part 20. Each terminal housing chamber 26 is opened outside in the length direction of the housing body 16 and in an upper surface 24 to extend toward the length direction in a substantially rectangular cross-sectional shape, and parallelly arranged with respect to a width direction (up-down direction FIG. 6). A pair of locking protrusions 30 and 30 each having a substantially rectangular column shape are provided to protrude in a central part in a width direction in a substantially central part of a bottom surface 28 of the terminal housing chamber 26 in the length direction. The pair of locking protrusions 30 protrude upward separately from each other in a longitudinal direction (right-left direction in FIG. 6) of the terminal housing chamber 26. As illustrated in FIG. 8, a locking claw 32 protruding toward outside in the longitudinal direction (right side in FIG. 8) in a substantially triangle cross-sectional shape is provided to protrude from a protruding end portion of the locking protrusion 30 located on a front side (right side in FIG. 6) of the pair of locking protrusions 30 and 30. The locking protrusion 30 and the locking claw 32 are included to constitute an elastic locking claw 34, and an upper surface 36 of the locking claw 32 is formed into a tapered surface inclined downward toward outside (right side in FIG. 8). A protrusion height dimension of the pair of locking protrusions 30 and 30 is formed lower in the front side than in the back side, however, it only indicates, as described hereinafter, that each of them is formed to correspond to a height dimension of a core wiring crimping part 76 and an electrical wiring crimping part 78 to which the pair of locking protrusions 30 and 30 are locked, respectively, from the bottom surface 28 of the terminal housing chamber 26.

As illustrated in FIGS. 5, 6, and 8, a locking protruding part 38 protruding to have a substantially rectangular shape in a planar view is formed on a back side in a width direction (up-down direction in FIG. 6) in a front side (right side in FIGS. 6 and 8) of the elastic locking claw 34 in the bottom surface 28 of the terminal housing chamber 26. Furthermore, a locking concave part 40 opened in the bottom surface 28 of the terminal housing chamber 26 is formed on a front side of the locking protruding part 38 (right side in FIGS. 6 and 8) (refer to FIGS. 6 and 8). In addition, as illustrated in FIGS. 2, 5, and 6, fitting protrusions 44 protruding toward outside to have a substantially rectangular cross-sectional shape and extending upward are provided at a front end portion and a back end portion of both side walls 42 and 42 in a width direction (up-down direction in FIG. 6) of the terminal housing part 20. A locking part 46 protruding toward outside and extending in a length direction to have a substantially trapezoidal cross-sectional shape is formed between the fitting protrusions 44 and 44 provided on each side wall 42.

In the meanwhile, as illustrated in FIGS. 2, 5, and 6, a plurality of substantially groove-like electrical wiring housing grooves 54 are opened in an upper surface 48 of the electrical wiring support part 22 and parallelly arranged in the upper surface 48 of the electrical wiring support part 22 in a width direction (up-down direction in FIG. 6). Each of the electrical wiring housing grooves 54 is connected to a back end side opening part 50 of the terminal housing chamber 26 and opened in a back end 52 of the housing body 16 to extend toward the length direction in a substantially rectangular cross-sectional shape. Furthermore, positioning protrusions 56 are provided to protrude from both end portions in a width direction on a back end side of the upper surface 48 of the electrical wiring support part 22 to have a substantially columnar shape. A protrusion tip portion of the positioning protrusion 56 is slightly tapered. In addition, a second positioning concave part 100 described hereinafter is provided at a position corresponding to the positioning protrusion 56 in a bottom surface of the electrical wiring support part 22.

As illustrated in FIGS. 1 and 2, the cover part 18 has a substantially block-like shape, and a locking release part 58 for releasing the locking between the connector 10 and the other side connector not shown in the drawings is provided at an upper part of the cover part 18. Locking frame bodies 62 having a substantially frame-like shape are provided on both side walls 60 and 60 on the front end side of the cover part 18. The locking frame body 62 extends toward a lower side in a substantially central part in a length direction, and a through hole 61 having a substantially rectangular cross-sectional shape passes through a central part of the locking frame body 62. In the meanwhile, fitting concave parts 64 opened in a lower side and both sides in a width direction are provided on both end portions of the side wall 60 in the length direction. Furthermore, provided at a back end side of the cover part 18 is a sandwiching part 66 protruding toward a back side (left side in FIG. 3) to have a substantially rectangular plate-like shape and extending toward both sides in a width direction (up-down direction in FIG. 3). A through hole 68 is formed in the both sides in the width direction on the back end side of the sandwiching part 66 to pass therethrough in a substantially circular cross-sectional shape in the up-down direction.

Figure 7:
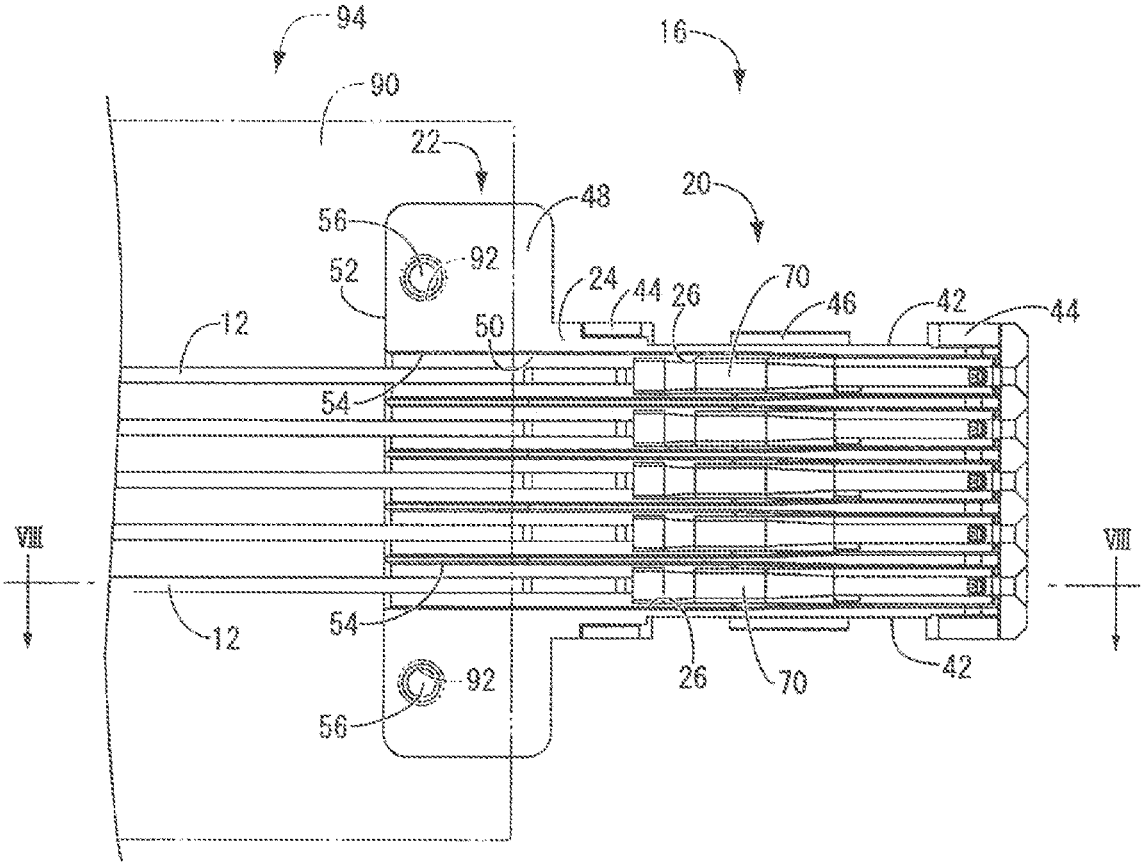
FIG. 7 A planar view illustrating a configuration that an electrical wiring including a connection terminal and a sheet-like reinforced member is housed and disposed in the housing body illustrated in FIG. 5.

As illustrated in FIGS. 2, 7, and 8, each connection terminal 70 is connected to each end of the electrical wiring 12. More specifically, an insulating coating 72 on a tip end side (right side in FIG. 8) of the electrical wiring 12 is peeled to expose a core wiring 74. Then, crimping work is performed for the core wiring 74 to the core wiring crimping part 76 of the connection terminal 70 and a tip portion of the electrical wiring 12 to which the core wiring 74 is exposed to the electrical wiring crimping part 78 of the connection terminal 70, thus the electrical wiring 12 is fixed and connected to the connection terminal 70. Furthermore, a tubular connection part 80 opened in a length direction (right-left direction in FIG. 8) is formed in a tip portion (right side in FIG. 8) of the connection terminal 70. As illustrated in FIG. 8, a recessed portion 82 is opened in a surface of the connection terminal 70 disposed to face the bottom surface 28 of the terminal housing chamber 26 between the core wiring crimping part 76 and the connection part 80. In addition, formed on an outer surface of the connection part 80 are a locking part 83 extending along an outer surface in a back end portion (left end portion in FIG. 8) on a lower part and a locking part 84 extending diagonally backward toward outside in a front end portion (right end portion in FIG. 8) on a lower part in FIG. 8. Formed in an inner surface of the connection part 80 is an elastic contact piece 86 extending along the inner surface from the back end portion (left end portion in FIG. 8) in the upper part and extending diagonally forward toward inside. The front end side (right end side in FIG. 8) on the lower part in FIG. 8 in the inner surface of the connection part 80 protrudes inward, thus an emboss part 88 is formed thereon. The elastic contact piece 86 and the emboss part 88 sandwich the other side terminal 89, thereby being connected to the other side connector. FIG. 8 illustrates the other side terminal 89 by an imaginary line to facilitate understanding. Furthermore, as illustrated in FIG. 2, the plurality of electrical wirings 12 extending from the connection terminal 70 are fixed to a sheet-like reinforced member 90 in a state of parallelly arranged. Positioning holes 92 each having a substantially circular cross-sectional shape are provided to pass through both sides in a width direction on a front end side (right end side in FIG. 7) of the sheet-like reinforced member 90 sandwiching the plurality of electrical wirings 12.

The electrical wiring 12 has a configuration that the core wiring 74 made up of a bundle of metal wirings of copper, aluminum, or the other conductive material, for example, is covered by the insulating coating 72 such as ethylene based resin or styrene based resin having an electrical insulation property. In the meanwhile, the connection terminal 70 is integrally formed using various metal materials with electrical conductivity on which a press working or a die-cut can be performed such as brass, copper, copper alloy, aluminum, aluminum alloy, for example. A glass fiber non-woven cloth or an aramid fiber non-woven cloth impregnated with epoxy resin or phenol resin, for example, is used as the sheet-like reinforced member 90, and the sheet-like reinforced member 90 is pressed to the electrical wiring 12 by heat press, for example, thereby being able to be fixed thereto.

The connector 10 having such a configuration is assembled in a manner described hereinafter. Firstly prepared is a sheet-like reinforced member-attached electrical wiring bundle 94 in which the plurality of electrical wirings 12 each having the end to which the connection terminal 70 is connected are parallelly arranged are fixed to the sheet-like reinforced member 90. Then, each of the plurality of connection terminals 70 provided at the end of each of the plurality of electrical wirings 12 in the sheet-like reinforced member-attached electrical wiring bundle 94 is housed and disposed in each of the terminal housing chambers 26 provided in the housing body 16, and the positioning protrusion 56 in the housing body 16 is fitted into the positioning hole 92 provided to pass through the sheet-like reinforced member 90. As a result, the plurality of electrical wirings 12 extending from the back end side opening part 50 of the terminal housing chamber 26 are housed and held in the electrical wiring housing groove 54 provided in the electrical wiring support part 22, and a front end portion side (right end side in FIG. 7) of the sheet-like reinforced member 90 is placed on the upper surface 24 of the housing body 16. More specifically, the connection terminal 70 is inserted into the terminal housing chamber 26 from above so that the pair of locking protrusions 30 and 30 are disposed in the recessed portion 82. Accordingly, the elastic locking claw 34 made up of the locking protrusion 30 with the locking claw 32 located on the front side (right side in FIG. 8) is elastically deformed to a back side, thereby allowing the connection terminal 70 to be inserted into the terminal housing chamber 26. Subsequently, when the connection terminal 70 is placed on the terminal housing chamber 26, the elastic locking claw 34 is elastically restored and the locking claw 32 of the elastic locking claw 34 goes into and is locked to the inner surface of the connection part 80 of the connection terminals 70, thereby advantageously preventing the connection terminal 70 from coming out of the terminal housing chamber 26 upward (refer to FIG. 8). As a result, the pair of locking protrusions 30 and 30 are inserted and disposed in the recessed portion 82 of the connection terminal 70, and the pair of locking protrusions 30 and 30 have direct contact with the front end portion of the core wiring crimping part 76 and the back end portion of the connection part 80, which constitute a formation surface of the recessed portion 82, respectively, on the both sides of the longitudinal direction (right-left direction in FIG. 8), thus the connection terminal 70 is positioned and held with respect to the terminal housing chamber 26 on the both sides of the longitudinal direction. In addition, the tubular connection part 80 of the connection terminal 70 into which the other side terminal 89 is inserted is disposed on the tip end side (right side in FIG. 8) of the terminal housing chamber 26 in the longitudinal direction. As described above, the elastic locking claw 34 is elastically restored and the locking claw 32 of the elastic locking claw 34 goes into and is locked to the inner surface of the connection part 80 of the connection terminal 70, thus an amount of the elastic locking claw 34 going into the inner surface of the connection part 80 is set within range not interfering the other side terminal 89.

Finally, the cover part 18 overlaps with the upper surface 24 of the housing body 16 from above, and the positioning protrusion 56 provided at the housing body 16 is pressed into the through hole 68 of the cover part 18. As a result, the cover part 18 covers the terminal housing chamber 26 of the housing body 16, and the front end portion of the sheet-like reinforced member 90 of the sheet-like reinforced member-attached electrical wiring bundle 94 is sandwiched between the electrical wiring support part 22 of the housing body 16 and the sandwiching part 66 of the cover part 18. Herein, a first positioning concave part into which the positioning protrusion 56 of the housing body 16 is fitted is formed to be opened in the lower surface of the cover part 18 by the through hole 68 of the cover part 18. Furthermore, the locking part 46 constituting the locking mechanism provided on the side wall 42 of the housing body 16 is locked to the through hole 61 of the locking frame body 62 constituting the locking mechanism provided on the side wall 60 of the cover part 18. That is to say, the cover part 18 and the housing body 16 are mutually locked and fitted by the locking mechanisms 62 and 46 provided on their side walls 60 and 42. In addition, the fitting protrusion 44 provided on the side wall 42 of the housing body 16 is fitted to the fitting concave part 64 of the fitting frame body 62 provided on the side wall 60 of the cover part 18. As described above, an overlapping state of the cover part 18 and the housing body 16 can be stably held, and the sheet-like reinforced member 90 can be sandwiched between the electrical wiring support part 22 of the housing body 16 and the sandwiching part 66 of the cover part 18 more stably.

According to the connector 10 having such a configuration, the terminal housing chamber 26 has the groove-like shape opened in the upper surface 24 of the housing body 16, thus the connection terminals 70 provided at the ends of the plurality of electrical wirings 12 of the sheet-like reinforced member-attached electrical wiring bundle 94 can be collectively fitted into the plurality of terminal housing chambers 26 from above. Thus, operability can be significantly increased compared with a conventional case where the plurality of connection terminals are housed one by one in a tubular terminal housing chamber whose four sides are surrounded by peripheral walls. Furthermore, the concentration of stress on the electrical wiring 12 extending from the terminal housing chamber 26 of the terminal housing part 20 of the housing body 16 is also reduced by housing and holding the electrical wiring 12 with the groove-like electrical wiring housing groove 54 connected to the back end side opening part 50 of the terminal housing chamber 26. In addition, the plurality of electrical wirings 12 extending from the connection terminal 70 are fixed to the sheet-like reinforced member 90 in the state of parallelly arranged, and the from end portion of the sheet-like reinforced member 90 is sandwiched between the sandwiching part 66 of the cover part 18 and the electrical wiring support part 22 of the housing body 16. Accordingly, the external force applied on the plurality of electrical wirings 12 can be reliably avoided or reduced, and the securement of the strength of electrical wiring 12 in such a portion can be reliably achieved. Thus, the groove-like terminal housing chamber 26 can be adopted even when an extra-fine wiring is adopted as the electrical wiring 12.

The positioning between the housing body 16, the sheet-like reinforced member 90, and the cover part 18 can be reliably performed by cooperation of the positioning protrusion 56 of the housing body 16, the positioning hole 92 of the sheet-like reinforced member 90, and the through hole 68 of the cover part 18. Accordingly, the sheet-like reinforced member 90 is stably held in a predetermined position between the housing body 16 and the cover part 18, and the strength of the electrical wiring 12 can be secured more reliably. Particularly, the positioning hole 92 of the sheet-like reinforced member 90 can be fitted and locked to the positioning protrusion 56 provided to protrude from the upper surface 48 of the electrical wiring support part 22, thus the sheet-like reinforced member 90 can be stably held by the electrical wiring support part 22 of the housing body 16 before the cover part 18 is attached, and the operability can be increased.

Figure 9:
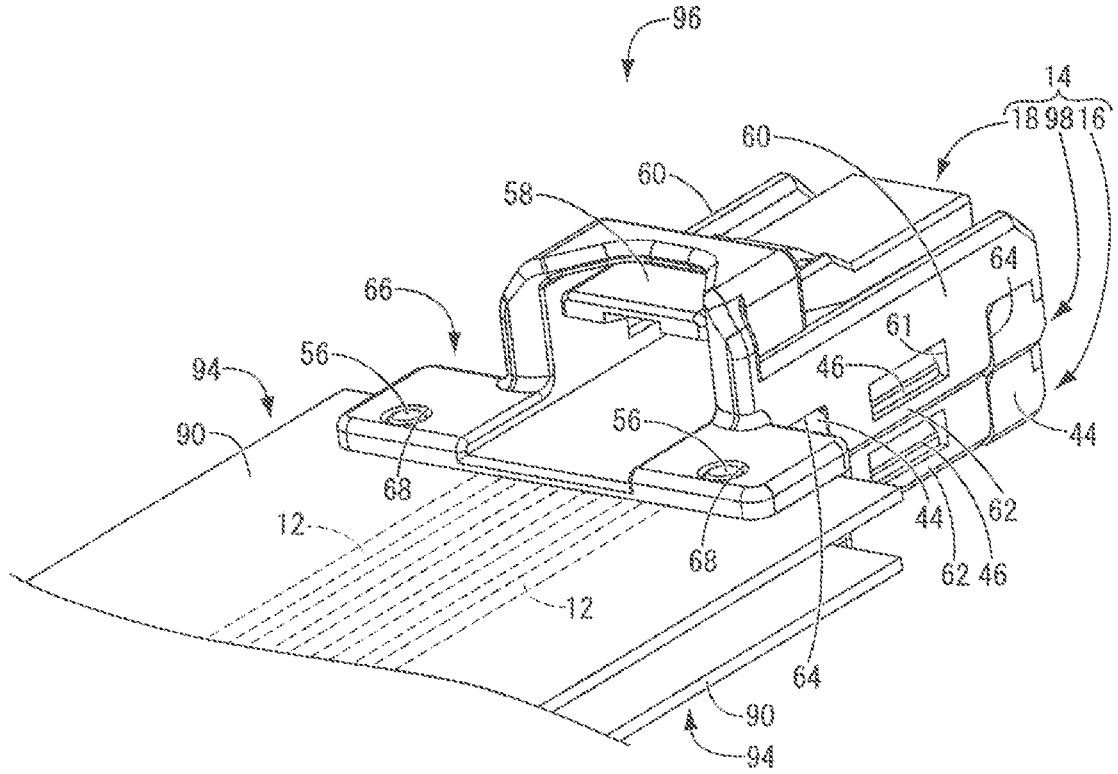
FIG. 9 An overall perspective view illustrating a connector as a second embodiment of the present invention.
Figure 10:
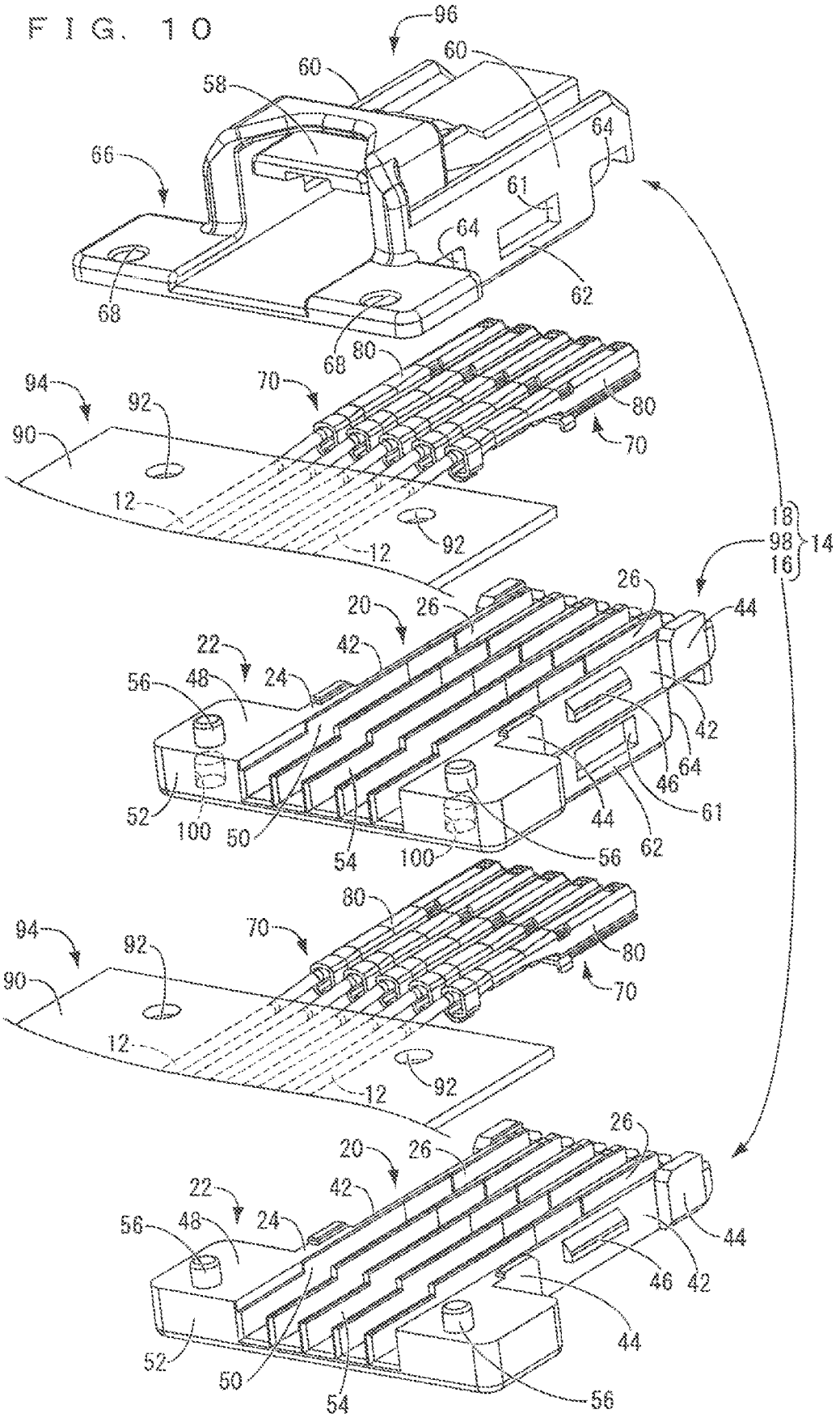
FIG. 10 An exploded perspective view of the connector illustrated in FIG. 9.

Details of the embodiments of the present invention are described above, however, the present invention is not limited to these specific descriptions. For example, in the above first embodiment, the housing body 16 is formed of a single layer, however, the housing bodies 98 and 16 may be vertically stacked in layers as is the case in the connector 96 as the second embodiment of the present invention illustrated in FIGS. 9 and 10. More specifically, as illustrated in FIGS. 9 and 10, the housing bodies 98 and 16 are vertically stacked in two layers, and the lower surface of the housing body 98 on the upper side overlapping with the housing body 16 on the lower side overlaps with the upper surface 24 of the housing body 16 on the lower side and covers the terminal housing chamber 26 of the housing body 16. Furthermore, the housing body 98 constitutes a middle cover part sandwiching the sheet-like reinforced member 90 between the middle cover part and the electrical wiring support part 22 of the housing body 16, and a second positioning concave part 100 into which the positioning protrusion 56 provided to protrude from the electrical wiring support part 22 of the housing body 16 on the lower side is fitted is provided in the middle cover part (refer to FIG. 10). The positioning protrusion 56 is pressed into the second positioning concave part 100, thus the housing bodies 98 and 16 vertically stacked in layers are positioned and fixed.

A shape of the housing body 98 disposed between the cover part 18 and the housing body 16 in a lowermost layer is the same as the housing body 16 in the lowermost layer except that the housing body 98 includes the locking frame body 62 constituting the locking mechanism. Thus, the housing bodies 16 and 98 can be manufactured with a reduced cost for mold. When the locking mechanism is not provided, only the housing body 16 can be used, thus the configuration and a parts management can be further simplified. Furthermore, in the second embodiment of the present invention illustrated in FIGS. 9 and 10, the housing bodies 98 and 16 are vertically stacked in two layers, however, the number of layers to be stacked can be easily increased by increasing the number of housing bodies 98 to be stacked.

In the embodiment described above, the positioning protrusion 56 is fitted to the through hole 68 constituting the first positioning concave part and the second positioning concave part 100 by pressing, but may be fitted by insertion. In such a case, the configuration of sandwiching the sheet-like reinforced member 90 may be made up of a locking mechanism such as the locking mechanisms 46 and 62, for example. Furthermore, the first positioning concave part may be the through hole 68 as the first embodiment described above or a recessed portion such as the second positioning concave part 100. In addition, a combination of the convex part and the concave part in the positioning protrusion 56, the through hole 68 constituting the first positioning concave part, and the second positioning concave part 100 may be a combination of the concave part and the convex part in reverse. That is to say, it is also applicable that the positioning protrusion 56 is provided at a side of the housing body 98 which is the cover part 18 and the middle cover part, and the concave part is formed in the upper surface 24 of the housing bodies 16 and 98.

In addition, the sheet-like reinforced member 90 is not limited to that exemplified above, however, any member can be optionally adopted as long as it has a sheet-like shape and can fix and hold the electrical wiring 12, such as a resin sheet material provided with an adhesion layer to fix the electrical wiring 12 or a fabric sheet material to which the electrical wiring 12 is sewn.

EXPLANATION OF REFERENCE SIGNS

10, 96: connector, 12: electrical wiring, 16: housing body, 18: cover part, 22: electrical wiring support part, 24: upper surface, 26: terminal housing chamber, 46: locking part (locking mechanism), 48: upper surface, 50: back end side opening part, 52: back end, 54: electrical wiring housing groove, 56: positioning protrusion, 62: locking frame body (locking mechanism), 68: through hole (first positioning concave part), 70: connection terminal, 90: sheet-like reinforced member, 92: positioning hole, 98: housing body (middle cover part), 100: second positioning concave part

What is claimed is:

1. A connector, comprising:

at least one plate-like housing body, wherein the housing body includes:

a plurality of groove-like terminal housing chambers each provided at a front end side of the housing body in a length direction, opened in an upper surface of the housing body, and arranged parallel to house a plurality of connection terminals provided at ends of a plurality of electrical wirings, and an electrical wiring support part provided at a back end side of the housing body in a length direction to support the plurality of electrical wirings extending from a back end side opening part of the terminal housing chambers;

a sheet-like reinforced member which is placed on an upper surface of the electrical wiring support part, and the plurality of electrical wirings are fixed to the sheet-like reinforced member in a parallel arrangement; and a cover part overlapping with the upper surface of the housing body to cover the terminal housing chambers and sandwiching the sheet-like reinforced member between the cover part and the electrical wiring support part, wherein a positioning protrusion is provided on the upper surface of the electrical wiring support part or a lower surface of the cover part, and the sheet-like reinforced member has a positioning hole into which the positioning protrusion is fitted, and the positioning protrusion is fitted into the positioning hole to fix the sheet-like reinforced member to the upper surface of the electrical wiring support part.

2. The connector according to claim 1, wherein a plurality of groove-like electrical wiring housing grooves connected to the back end side opening part of the terminal housing chambers and opened on the back end side of the housing body are opened in the upper surface of the electrical wiring support part and arranged parallel in the upper surface of the electrical wiring support part.

3. The connector according to claim 2, wherein the plurality of terminal housing chambers is configured to house the plurality of connection terminals from a side of the upper surface of the housing body, respectively, the plurality of electrical wiring housing grooves is configured to house the plurality of electrical wirings from the side of the upper surface of the housing body, respectively, and the cover part sandwiches a portion of the plurality of electrical wirings of the sheet-like reinforced member fixed in the parallel arrangement with the electrical wiring support part.

4. The connector according to claim 2, wherein the plurality of connection terminals are housed in the plurality of terminal housing chambers, respectively, and the plurality of electrical wirings are housed in the plurality of electrical wiring housing grooves in a condition of being fixed to the sheet-like reinforced member and supported by the electrical wiring support part.

5. The connector according to claim 1, wherein the cover part and the housing body are mutually locked and fitted by a lock mechanism provided on a side wall, and the lock mechanism is provided in a position different from the positioning protrusion in a longitudinal direction of the housing body.

6. The connector according to claim 1, wherein the plurality of connection terminals are crimped to the ends of the plurality of electrical wirings.

7. A connector, comprising:

at least one plate-like housing body, wherein the housing body includes:

a plurality of groove-like terminal housing chambers each provided at a front end side of the housing body in a length direction, opened in an upper surface of the housing body, and arranged parallel to house a plurality of connection terminals provided at ends of a plurality of electrical wirings, and an electrical wiring support part provided at a back end side of the housing body in a length direction to support the plurality of electrical wirings extending from a back end side opening part of the terminal housing chambers;

a sheet-like reinforced member which is placed on an upper surface of the electrical wiring support part, and the plurality of electrical wirings are fixed to the sheet-like reinforced member in a parallel arrangement; and a cover part overlapping with the upper surface of the housing body to cover the terminal housing chambers and sandwiching the sheet-like reinforced member between the cover part and the electrical wiring support part, wherein a positioning protrusion is provided on the upper surface of the electrical wiring support part or a lower surface of the cover part, the sheet-like reinforced member has a positioning hole into which the positioning protrusion is fitted, and the positioning protrusion is fitted into the positioning hole to fix the sheet-like reinforced member to the upper surface of the electrical wiring support part, more than one of the housing body being vertically stacked in layers and including a housing body on an upper side and a housing body on a lower side, a lower surface of the housing body on the upper side overlapping with the housing body on the lower side constitutes a middle cover part overlapping with the upper surface of the housing body on the lower side, covering each of the terminal housing chambers, and sandwiching the sheet-like reinforced member between the middle cover part and the electrical wiring support part, and a second positioning concave part into which a positioning protrusion, which is provided to protrude from the electrical wiring support part in the housing body on the lower side, when fitted is provided at the middle cover part, and the housing bodies vertically stacked are positioned and fixed by fitting the positioning protrusion into the second positioning concave part.

* * * * *